United States Patent [19]

Jacobson

[11] 4,011,674

[45] Mar. 15, 1977

[54] MAGNETIC KINETIC AMUSEMENT DEVICES

[76] Inventor: Sava W. Jacobson, 4915 Tyrone Ave., Sherman Oaks, Calif. 91403

[22] Filed: Sept. 25, 1975

[21] Appl. No.: 616,762

Related U.S. Application Data

[62] Division of Ser. No. 492,042, July 26, 1974, Pat. No. 3,908,307.

[52] U.S. Cl. ..... 40/39; 40/106.54; 46/238; 273/1 M

[51] Int. Cl.[2] ..... A63H 33/26

[58] Field of Search ..... 272/1 R, 8 R, 8 D, 8 N; 35/19 R, 19 A; 40/28 C, 28.1, 37, 39, 40, 51, 106.21, 106.25, 106.45, 126 R, 128, 130 R, 138, 142 A, 106.54; 46/57, 236, 238, 239, 240; 310/6; 324/34 PL, 72, 109; 335/209, 306; 340/373; 273/1 M

[56] References Cited

UNITED STATES PATENTS

| | | | |
|---|---|---|---|
| 1,974,737 | 9/1934 | Casteig | 40/39 |
| 2,092,520 | 9/1937 | Nielsen | 40/28.1 |
| 2,952,835 | 9/1960 | Aiken | 324/109 X |
| 3,048,777 | 8/1962 | Schaschl | 324/109 X |
| 3,478,466 | 11/1969 | Conner | 46/236 |
| 3,550,316 | 12/1970 | MacPherson | 46/238 |
| 3,562,938 | 2/1971 | Salam | 40/28 C |
| 3,609,606 | 9/1971 | Podesto | 335/209 |
| 3,621,424 | 11/1971 | Query | 335/306 |
| 3,776,548 | 12/1973 | Glass et al. | 273/1 M |
| 3,901,505 | 8/1975 | Gerechter | 273/1 M |
| 3,902,263 | 9/1975 | Schuman | 40/106.25 |
| 3,955,315 | 5/1976 | Goodman | 46/238 |

OTHER PUBLICATIONS

"Electrostatics", Scientific Apparatus and Supplies, The Welch Scientific Co., copyright 1968, pp. 181, 184.

*Primary Examiner*—Richard T. Stouffer
*Attorney, Agent, or Firm*—Howard A. Silber

[57] ABSTRACT

These magnetic kinetic amusement devices have plural magnetically coupled elements that exhibit intermittent, alternating motion as energy is interchanged between the elements. In one embodiment, plural vertically spaced arms are mounted for pivotal motion about a common vertical axis. Each arm has a pair of magnets at its extremities. As it rotates through a partial revolution, its kinetic energy is magnetically coupled to an adjacent arm. As a result, adjacent arms alternately rotate through fractional revolutions, providing quantized motion that is fascinating to watch.

In other embodiments the magnetically coupled elements comprise pendulums each having at the pendulum end a design member containing a magnet. The plural pendulums may be disposed in three dimensional array, or may be suspended from a common support with the magnets aligned for mutual repulsion so that the pendulums assume a conical arrangement. Displacement or rotation of any pendulum design member causes energy exchange through magnetic coupling, resulting in an eye-appealing intermittently alternating motion of all design members.

3 Claims, 9 Drawing Figures

MAGNETIC KINETIC AMUSEMENT DEVICES

This is a division, of application Ser. No. 492,042, filed July 26, 1974, now U.S. Pat. No. 3,908,307.

BACKGROUND OF THE INVENTION

1. Field of the Invention

The present invention relates to magnetic kinetic amusement devices wherein there is an intermittent interchange of motional energy between dynamic components by magnetic coupling.

2. Description of the Prior Art

A variety of magnetic amusement devices and kinetic sculptures are known. In such devices, movable members are magnetically attracted or repelled by magnets on adjacent units to provide suspensory or motion effects. Often the objective is eye appeal, as for display purposes. For example, in the display apparatus of the Littlefield U.S. Pat. No. 3,196,566 a model airplane is suspended in air by magnetic repulsion between a magnet in the model and two spaced magnets in an underlying stationary base.

Other devices are characterized by magnetically imparted motion. Thus in the U.S. Pat. No. 2,220,049 to Dunmore, a pendulum-suspended figure is provided with a magnet that coacts with another magnet mounted below a platform. The sub-platform magnet may be fixed at a location offset from the pendulum rest axis, or may be driven through a circular or irregular path in a plane parallel to but beneath the platform. The suspended figure swings and rotates in some more or less random pattern under magnetic influence.

The magnetic amusement device of MacPherson (U.S. Pat. No. 3,550,316) uses a pair of pivotally supported, balanced rods each having a magnet at one end and a counterweight at the other end. Due to magnetic interaction, when one rotor is spun gently, rotation is imparted in the opposite direction to the other balanced rod. Depending on the speed of rotation, the interaction of the magnetic fields may effect the transfer of enertial energy as the magnet ends pass adjacent to each other causing changes in speed and sometimes reversal of direction of rotation.

In the Podesto kinetic sculpture of U.S. Pat. No. 3,609,606 a pair of magnets are attached to the free ends of a pair of artistically shaped spring wires that extend from a base. Repulsion between the magnetics imparts random, tremor-like motion to the springs.

An object of the present invention is to provide magnetic kinetic amusement devices in which there is a continuing, but intermittant exchange of motional energy between dynamic members, accomplished by magnetic coupling. In certain embodiments, the energy interchange is between a plurality of oscillating members. The resultant motional effects are fascinating to the viewer.

SUMMARY OF THE INVENTION

This object is achieved by providing a kinetic amusement device having a plurality of movably mounted members each provided with a magnet. The members are spatially disposed to effectuate magnetic coupling that produces intermittent energy interchange between members.

In one embodiment, the members comprise vertically separated arms all mounted for rotation about a common axis. A magnet is affixed to each end of every arm. These are poled so that rotational energy from one arm is magnetically coupled to the arm immediately above or below during each partial revolution of each arm. As a result, the arms seem to exhibit quantized motion.

In another embodiment, each member is suspended like a pendulum with a magnet at its lower end. The plural magnet-equipped pendulums are arranged in a three-dimensional array in which both rotational and swinging motion of each pendulum is intermittently exchanged by magnetic coupling with other nearby members. In a further configuration, a plurality of adjacent pendulum-suspended elements are provided with magnets poled for mutual repulsion. Torsional oscillatory motion of each suspended element intermittently is interchanged magnetically with the adjacent pendulum elements. Eye-appealing, irregular motion is achieved by each of these embodiments.

BRIEF DESCRIPTION OF THE DRAWINGS

A detailed description of the invention will be made with reference to the accompanying drawings wherein like numerals designate corresponding elements in the several figures. These drawings, unless described as diagrammatic or unless otherwise indicated, are to scale.

DESCRIPTION OF THE PREFERRED EMBODIMENTS

The following detailed description is of the best presently contemplated modes of carrying out the invention. This description is not to be taken in a limiting sense, but is made merely for the purpose of illustrating the general principles of the invention since the scope of the invention best is defined by the appended claims.

Operational characteristics attributed to forms of the invention first decribed also shall be attributed to forms later described, unless such characteristics obviously are inapplicable or unless specific exception is made.

Figure 1:
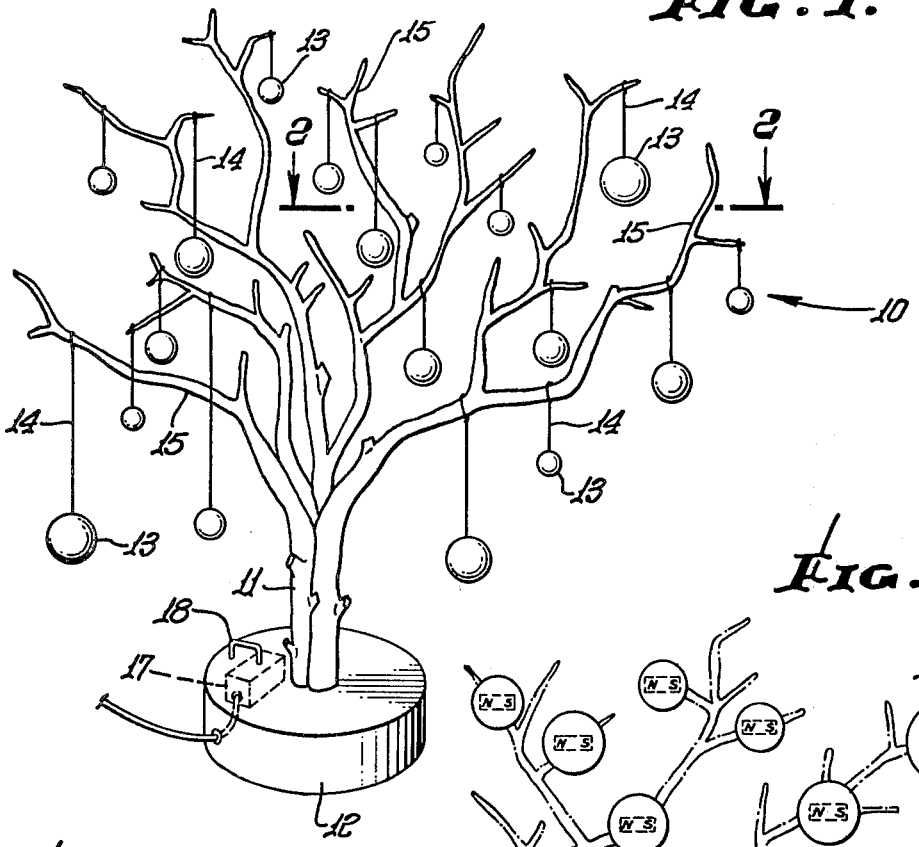
FIG. 1 is a pictorial view of a magnetic kinetic sculpture in accordance with the present invention.
Figure 2:
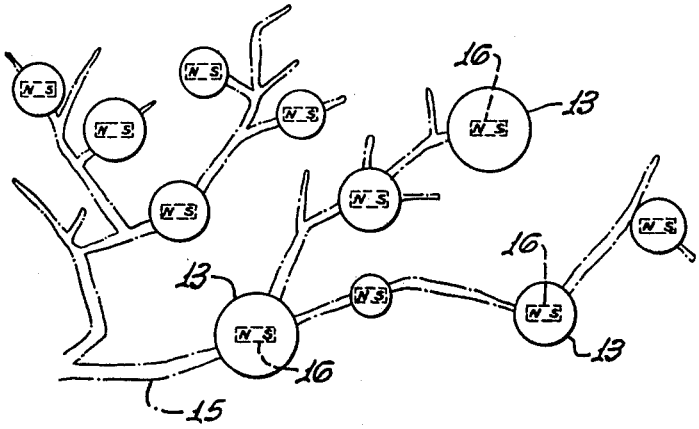
FIG. 2 is a fragmentary schematic view of the sculpture of FIG. 1, as viewed along the line 2—2 thereof, indicating the magnetic alignment within the various dynamic members of the sculpture.

The kinetic sculpture 10 of FIG. 1 has the general appearance of a stylized Christmas tree. The tree trunk 11 is attached to a weighted base 12. A plurality of light weight balls or other decorative elements 13 are suspended by individual strings 14 from the various branches 15 of the tree 10. Each suspended element 13 contains a small permanent magnet 16 (FIG. 2) that may be aligned in a horizontal plane. By way of example, each element 13 may comprise a ball of polyurethane foam with the magnets 16 press fit into a recess formed in the ball. Preferably the ends of each magnet 16 are not exposed, but are covered by some non-magnetic material that will provide a barrier to prevent latching of the magnets in adjacent elements 13. Such linking together of the elements 13 also is minimized by arranging these elements in a three dimensional array such that nearby elements are in different horizontal planes.

Swinging or rotational motion imparted to one or more of the elements 13 intermittently will be transferred by magnetic coupling to other nearby elements. The result is that all of the elements will oscillate torsionally through a partial revolution. However, as the kinetic energy of one element is transferred, causing an adjacent element to rotate, the one element may slow or stop its motion while the recipient element begins or increases its motion. The result is a fascinating display characterized by intermittent, primarily torsional motion of all elements.

To impart the initial motion to the elements 13, the base 12 may be equipped with a device for producing a changing magnetic field. For example, a motor 17 may be used to rotate a permanent magnet 18 through a circular path. Alternatively, an electromagnet may be energized from time to time to provide a changing magnetic field that will impart motion to the elements 13.

Figure 3:
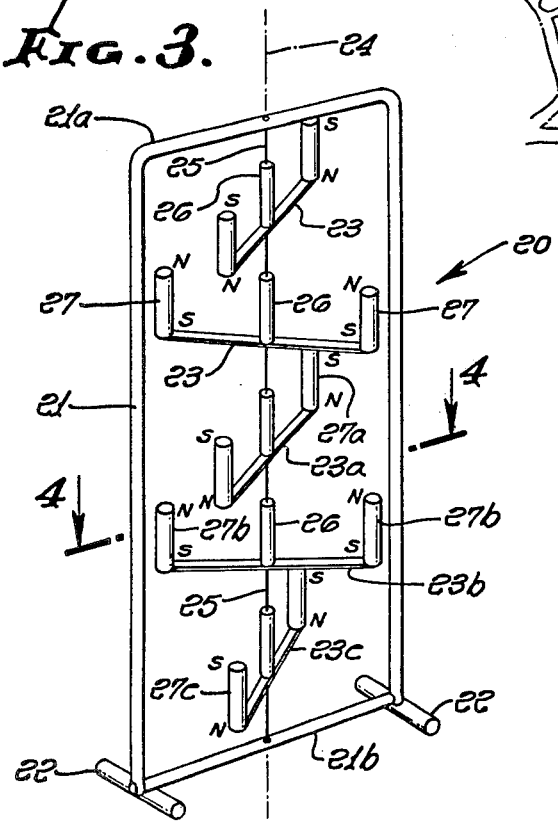
FIG. 3 is a perspective view of another embodiment of the invention employing plural, magnetically coupled rotary arms.

The magnetic amusement device 20 of FIG. 3 has a generally rectangular frame 21 that may be made of plastic rod. The frame 21 is held upright by feet 22. A plurality of rigid arms 23 are supported within the frame 21 for independent rotation about a common vertical axis 24. For example, the arms 23 may be suspended along a thread 25 that is stretched between the upper and lower frame members 21*a* and 21*b*. The thread 25 may extend through, and be attached to a central tubular member 26 connected to each arm 23. In this manner, appropriate vertical spacing is maintained between adjacent arms 23.

A pair of permanent magnets 27 is attached vertically to the ends of each arm 23. The magnets of subjacent arms are aligned repulsively. Thus the magnets 27*a* on the arm 23*a* have their north poles at the bottom, and the magnets 27*b* of the subjacent arm 23*b* have their north poles at the top. Similarly, the magnets 27*c* of the next lower arm 23*c* have their south poles at the top.

Figure 4:
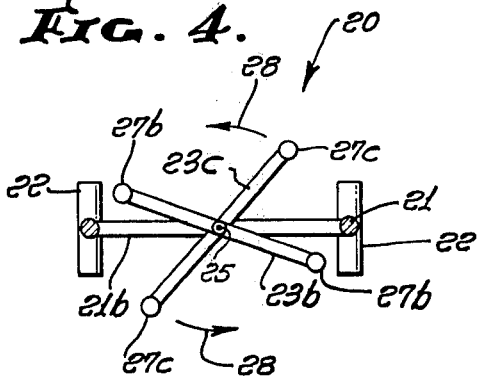
FIG. 4 is a transverse sectional view of the device of FIG. 3 as viewed along the line 4—4 thereof.

A very unique motion is exhibited by the device 20. If one of the arms 23 is rotated gently, its rotational energy will be imparted by the magnets 27 to the arm immediately above or below. As a result of this energy interchange, the first arm may stop rotating with the rotation being continued by the adjacent arm. For example, if the initial motion is imparted to the arm 23*b* in a counterclockwise direction as viewed in FIG. 4, the arm 23 will rotate through approximately one-half revolution. The repulsion between the magnets 27*b* and 27*c* will impart a rotational energy in the same direction to the arm 23*c*, as indicated by the arrows 28. The arm 23*b* they actually stop, while the arm 23*c* commences rotation in the same direction. When it has gone through about one-half turn, the magnets 27*c* again will reach proximity to the magnets 27*b*, and yet another energy interchange will take place. The arm 23*c* will slow down or stop, and the arm 23*b* will be impelled through another partial revolution. Of course, this exchange of energy is taking place between all of the arms 23 in the device 20.

If the string 25 is attached to the members 26, rotation of the various arms 23 will twist the string 25, leading to a torsional oscillation. That is, after some period of time the various arms will stop their intermittant rotation in the first direction, and will be impelled in the reverse direction by the torsional action of the twisted string 25. The same energy interchange will occur in the reverse direction for some duration of time. Thus the motion of the device 20 not only is an alternating partial revolution of adjacent arms, but will include rotation in both directions over some long term period. The motion is sufficiently complex so as to hold the viewer's attention for a long time.

Figure 8:
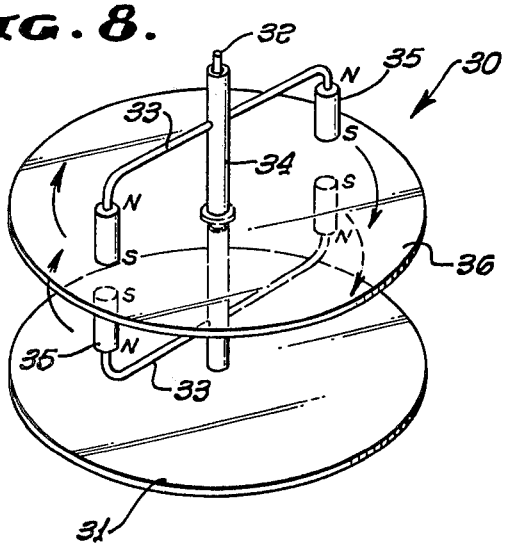
FIG. 8 is a pictorial view of a kinetic sculpture having an operational mode like that of the device of FIG. 3.

The device 30 of FIG. 8 operates in a manner like that of device 20, but without the torsional oscillation provided by the string 25. In the device 30, the supporting frame consists of a planar base 31 to which is affixed a rigid, vertical shaft 32. Each horizontal arm 33 extends from an attached vertical rod 34 that loosely surrounds the shaft 32. A pair of magnets 35 is mounted vertically at the ends of each arm 33. As in the device 20, the magnet poles for subjacent arms are aligned repulsively. A planar disc 36 of rigid, non-magnetic material is mounted to the shaft 32 between each pair of arms 33, to serve as a physical barrier therebetween. Advantageously the disc 36 consists of a sheet of transparent plastic.

When gentle rotational motion is imparted to one of the arms 33, some of the rotational energy will be imparted magnetically to the other arm 33. In a manner like that described above, each arm 33 typically will undergo half turn revolution, whereupon it will slow down or stop, imparting its energy into rotation of the next arm 33 which likewise will rotate for about one-half turn. Since there is no torsional return force, the alternating rotation will continue in the same direction.

Figure 6:
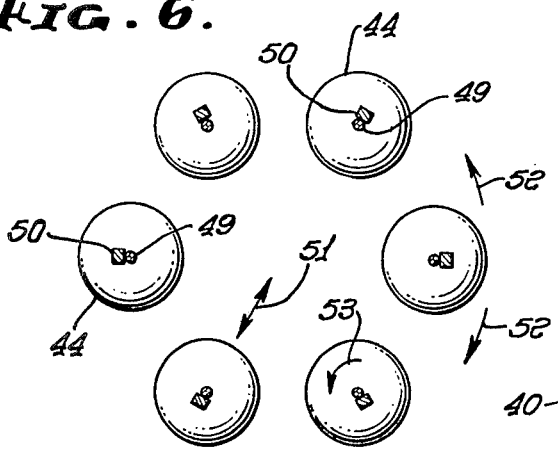
FIG. 6 is a transverse sectional view of the device of FIG. 5 as viewed along the line 6—6 thereof.
Figure 5:
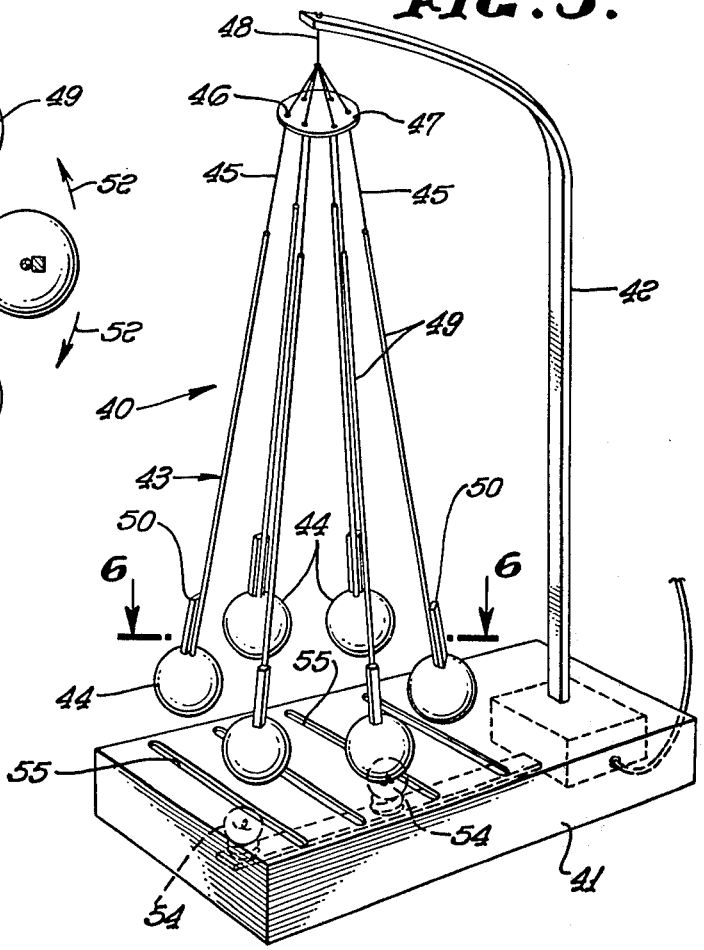
FIG. 5 is a pictorial view of a magnetic amusement device employing plural suspended rotational members having mutually repulsive magnetic elements.

In another configuration of the present invention is embodied in the magnetic amusement device 40 of FIGS. 5 and 6. Here the frame includes a weighted base 41 that carries a generally inverted-L-shaped support 42. Suspended therefrom are a plurality of pendulum-like members 43 each consisting of a ball 44 attached to the lower end of a thread 45. The upper ends of all the threads 45 pass through holes 46 that are circularly disposed in a disc 47. The thread ends then are tied together and suspended from the support 42 by a common leader 48. Each thread 45 may be guided through a light-weight tube 49 that limits bending of the individual threads 45.

An individual, thin bar magnet 50 is attached to each ball 44 in generally vertical alignment with the associated thread 45 and tube 49. The magnets 50 are poled for mutual repulsion. For example, all of the magnets 50 may have their south pole at the top end. As a result of this mutual repulsion, the balls will spread apart as shown in FIG. 5, so that the plural threads 45 and tubes 49 lie in a conical section.

If any ball 44 is displaced radially from this conic section, as indicated by the arrow 51 of FIG. 6, the remaining balls 44 all will move radially inward or outward as a result of the magnetic coupling. Similarly, the displacement of one ball 44 about the periphery of the cone, as indicated by the arrows 52, will cause displacement of the other balls.

Note that the magnets 41 are offset laterally from the axis of the associated thread 45. As a result, if one of the balls is rotated about the thread, as indicated by the arrow 53 of FIG. 6, this rotational motion also will be imparted to adjacent balls. In all of these modes of displacement, the energy coupling between adjacent members 43 typically will be intermittant, so that an irregular, "dancing" motion is produced that is interesting to watch.

The base 41 may be provided with a magnetic device, such as the motor 17 and magnet 18 of FIG. 1, to impart motion to the device 40. Alternatively, as shown in FIG. 5, the base 41 may be provided with one or more small light bulbs 54. The heat generated by these lamps will rise through louvers 55 in the base 41, and will be sufficient to cause motion of the balls 44, if these are made of some light weight material such as polyurethane foam.

Figure 7:
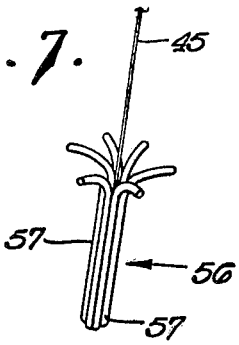
FIG. 7 is a pictorial view of an alternative configuration for the suspended, magnet containing member of the device of FIG. 5.

The configuration of the pendulum end element is totally arbitrary. Thus each ball 44 may be replaced with an object of a different shape, such as the design 56 of FIG. 7. This element consists of plural short sections 57 of plastic tubing that are bent outward at the top. The magnet 50 is completely surrounded by these rod sections.

Figure 9:
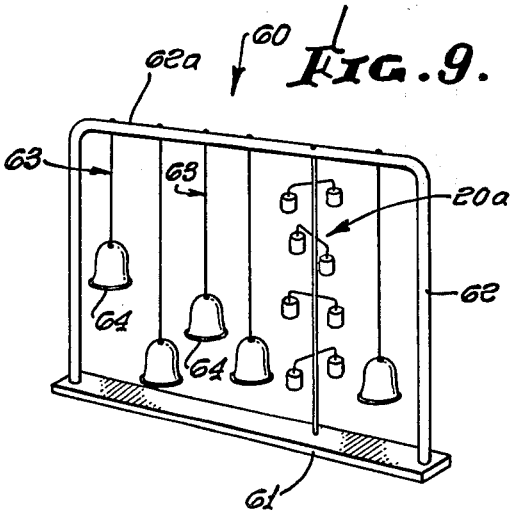
FIG. 9 is a pictorial view of a toy combining several embodiments of the invention.

The device 60 of FIG. 9 is useful as a crib toy for very young children, and combines two versions of the present invention. The frame of the device 60 consists of an elongate, planar base 61 that carries a rigid, inverted U-shaped support 62 that may be formed of plastic tubing. Suspended between the base 61 and the upper section 62*a* of the support 62 is a rotational kinetic magnetic amusement device 20A of the type described in connection with FIG. 3. Also suspended from the support section 62*a* are a plurality of pendulums 63 each having a different length. A fanciful item such as a bell 64 is situated at the bottom of each pendulum 63. Each such item contains a magnet, so that there is an interchange of energy between the pendulums 63 of the sort described in conjunction with the device 10 of FIG. 1. When placed near a child's crib, the device 60 will not only occupy the child for some period of time, but will provide valuable exercise in eye coordination as the child follows the magnetically coupled motion of the pendulums 63 and the device 20A.

Intending to claim all novel, useful and unobvious features shown or described, the applicant claims:

1. A magnetic kinetic amusement device comprising:
a frame,
at least three magnetic elements,
at least three mounting means supported by said frame, at least one magnetic element being mounted by each such means, said magnetic elements each having the same type of pole facing upwardly as each other magnetic element, said magnetic elements thus being supported in spaced, magnetically coupled relationship so that motion of one mounting means intermittently is interchanged magnetically with another such mounting means to produce intermittent alternating motion of the magnetically coupled means, and
wherein each mounting means comprises a design member situated at the bottom of an individual string, a magnetic element being attached to each such design member, each string being attached to a location on said frame spaced from the location of attachment to the frame of each other string with said locations being spaced apart in more than one dimensional plane so that said design members are spatially distributed in three-dimensional array,
each string permitting both swinging and rotational motion of the attached design member.

2. A device according to claim 1 together with means for imparting motion to at least one of said mounted magnetic elements.

3. A magnetic kinetic amusement device comprising:
a frame,
at least three magnetic elements,
at least three of mounting means supported by said frame, at least one magnetic element being mounted by each such means, said magnetic elements thus being supported in spaced, magnetically coupled relationship so that motion of one mounting means intermittently is interchanged magnetically with another such mounting means to produce intermittent alternating motion of the magnetically coupled means,
wherein said mounting means comprises at least three pendulums suspended from a common support portion of said frame, said pendulums being spaced apart in more than one dimensional plane, each pendulum further having a design member at its lower end, each design member being provided with one of said magnetic elements, said magnetic elements being poled so that each magnetic element has the same type of pole facing upwardly as each other magnetic element, whereby said pendulums are magnetically repelled into conical alignment, displacement or rotation of any design member being intermittently, magnetically coupled to cause intermittent, alternating motion of adjacent pendulums, and
wherein the magnetic element of each pendulum comprises a thin bar magnet generally aligned with the pendulum support axis, the bar magnets for all of said pendulums being mounted for mutual repulsion.

* * * * *